US009341067B2

(12) United States Patent
Kayser

(10) Patent No.: US 9,341,067 B2
(45) Date of Patent: May 17, 2016

(54) BLADE ARRANGEMENT AND ASSOCIATED GAS TURBINE

(75) Inventor: Andreas Kayser, Wuppertal (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 496 days.

(21) Appl. No.: 13/825,357

(22) PCT Filed: Sep. 20, 2011

(86) PCT No.: PCT/EP2011/066287

§ 371 (c)(1), (2), (4) Date: Mar. 21, 2013

(87) PCT Pub. No.: WO2012/038406

PCT Pub. Date: Mar. 29, 2012

(65) Prior Publication Data

US 2013/0177427 A1 Jul. 11, 2013

(30) Foreign Application Priority Data

Sep. 24, 2010 (EP) ..... 10179376

(51) Int. Cl.

| | |
|---|---|
| ***F01D 5/10*** | (2006.01) |
| ***F03B 11/04*** | (2006.01) |
| ***F01D 25/06*** | (2006.01) |
| ***F01D 5/26*** | (2006.01) |
| ***F01D 5/22*** | (2006.01) |

(52) U.S. Cl.
CPC ... *F01D 5/26* (2013.01); *F01D 5/22* (2013.01)

(58) Field of Classification Search
CPC ..... F01D 5/22; F01D 5/26; F01D 5/225; F01D 25/06; F05D 2260/96
USPC ..... 416/190, 500, 145, 193 A, 119
See application file for complete search history.

(56) References Cited

U.S. PATENT DOCUMENTS

| | | | | |
|---|---|---|---|---|
| 1,618,285 A | | 2/1927 | Kasley | |
| 2,310,412 A | * | 2/1943 | Fianders | F01D 5/225 416/190 |
| 2,997,274 A | * | 8/1961 | Hanson | F01D 5/26 416/140 |
| 3,266,770 A | * | 8/1966 | Harlow | F01D 5/081 416/174 |
| 3,666,376 A | | 5/1972 | Damlis | |
| 4,178,667 A | * | 12/1979 | Stevens et al. | 29/889.2 |
| 4,343,594 A | * | 8/1982 | Perry | 416/193 A |

(Continued)

FOREIGN PATENT DOCUMENTS

| | | |
|---|---|---|
| CN | 2469184 Y | 1/2002 |
| CN | 101158290 A | 4/2008 |

(Continued)

*Primary Examiner* — Jorge Pereiro
*Assistant Examiner* — Jason T Newton

(57) ABSTRACT

A blade arrangement with a rotor and a plurality of blades which are distributed in a ring along the circumference of the rotor is provided. Two immediately adjacent blades of the ring form a blade pair, between the blades of which a damping element is arranged, and wherein the respective damping element comes into contact with the two blades of the blade pair assigned to them during a rotation of the rotor about a rotor axis as a result of a centrifugal force which acts in the radial direction. In order to bring about frequency detuning of the oscillation properties of blades, as a result of which machining of the turbine blade becomes unnecessary, it is proposed that the blade ring has at least two blade pairs with different damping elements.

5 Claims, 4 Drawing Sheets

(56) References Cited

U.S. PATENT DOCUMENTS

| | | | | |
|---|---|---|---|---|
| 4,917,574 | A | 4/1990 | Pateman | |
| 5,156,528 | A * | 10/1992 | Bobo | F01D 5/22 416/190 |
| 6,042,336 | A * | 3/2000 | Bulgrin | F01D 5/22 416/145 |
| 6,478,544 | B2 * | 11/2002 | Brandl et al. | 416/190 |
| 7,021,898 | B2 * | 4/2006 | Elliott et al. | 416/193 A |
| 8,137,072 | B2 * | 3/2012 | Kim et al. | 416/193 A |
| 8,506,253 | B2 * | 8/2013 | Lecuyer et al. | 416/145 |
| 8,876,472 | B2 * | 11/2014 | Dijoud et al. | 416/2 |
| 2001/0038793 | A1 | 11/2001 | Kellerer | |
| 2010/0021302 | A1 * | 1/2010 | Kayser | F01D 5/22 416/145 |
| 2015/0125304 | A1 * | 5/2015 | Rapp | F01D 5/22 416/190 |
| 2015/0167479 | A1 * | 6/2015 | Hartung | F04D 29/023 416/241 R |

FOREIGN PATENT DOCUMENTS

| | | | |
|---|---|---|---|
| CN | 101542073 | A | 9/2009 |
| DE | 819242 | C | 10/1951 |
| EP | 1154125 | A1 | 11/2001 |
| EP | 1154125 | A2 | 11/2001 |
| FR | 1263677 | A | 6/1961 |
| JP | 7002962 | Y2 | 3/1986 |
| JP | 2000161005 | A | 6/2000 |
| JP | 2006125372 | A | 5/2006 |
| JP | 2010510436 | A | 4/2010 |
| JP | 48064303 | | 2/2012 |
| SU | 156165 | A1 | 8/1963 |

* cited by examiner

BLADE ARRANGEMENT AND ASSOCIATED GAS TURBINE

CROSS REFERENCE TO RELATED APPLICATIONS

This application is the US National Stage of International Application No. PCT/EP2011/066287, filed Sep. 20, 2011 and claims the benefit thereof. The International Application claims the benefits of European Patent Office application No. 10179376.8 EP filed Sep. 24, 2010. All of the applications are incorporated by reference herein in their entirety.

FIELD OF INVENTION

The invention relates to a blade arrangement, with a rotor and a plurality of blades which are distributed in a ring along the circumference of the rotor, wherein two immediately adjacent blades of the ring from a blade pair, between the blades of which a damping element is arranged, and wherein the respective damping element comes into contact with the two blades of the blade pair assigned to them during a rotation of the rotor about a rotor axis as a result of a centrifugal force acting in the radial direction.

BACKGROUND OF INVENTION

It is known to provide blade arrangements that are used in turbomachines such as gas turbines with damping elements. These serve the purpose of damping undesired flexural and torsional vibrations that may occur during operation in the turbomachine as a result of various inducing factors. In this way, instances of HCF damage (abbreviation for "High Cycle Fatigue") that are caused by high vibration amplitudes and could lead to premature material fatigue, and to a consequently shortened service life of the blades or the blade arrangement, can be avoided. The damping elements are in this case arranged between the individual blades. Generally used as damping elements are loose bodies which, in the state of rest, initially lie between the blade roots of the blades on the rotor or on corresponding supporting structures and during operation of the rotor are pressed against the underside of the blade platforms of adjacent blades as a result of the centrifugal force acting in the radial direction. Each damping element is in this case in contact with both adjacent blade platforms at the same time. This allows the kinetic energy of a relative movement between the blades that is induced by vibrations to be converted into thermal energy, as a result of the friction between the respective blade platforms and the adjoining damping element. This damps the vibrations and leads altogether to a reduced vibrational loading of the blade arrangement.

In the case of older turbomachines, blade airfoil vibrations were usually suppressed with the aid of stiffening elements that coupled the blade airfoils directly to one another. Design solutions for this are disclosed by patent specifications DE 819 242 C and U.S. Pat. No. 1,618,285 A.

The document EP 1 154 125 A2 discloses a blade arrangement in which at least two damping elements are arranged one behind the other between adjacent blades in the circumferential direction of the rotor, in order to achieve effective damping of the blade arrangement as a whole. The damping elements disclosed in this document are configured in a form differing from each other, in order to be able as far as possible to damp a large number of different modes of vibration. By way of the contact regions forming between the damping elements and the blades, and furthermore by way of the contact regions forming between the individual damping elements, vibrational energy can be converted into thermal energy for vibration damping by frictional action. However, the contact regions forming between the individual damping elements have only the form of a linear contact, with which there is only a moderate associated damping effect.

Other forms of dampers are likewise known, for example according to FR 1263 677 A the arrangement of a multiplicity of balls between two adjacent rotor blades.

SUMMARY OF INVENTION

The invention is based on the object of providing a blade arrangement with damping elements with which undesired vibrations can be damped even more effectively and the tendency of the blades to vibrate as a result of an inducing factor can be reduced or even avoided.

This object is achieved by a blade arrangement according to the features of the claims.

According to the invention, it is provided in the case of the blade arrangement mentioned at the beginning that the blade ring has at least two blade pairs with different damping elements.

The invention is based on the realization that the coupling of the blades to damping elements also has the effect of increasing the natural frequencies in relation to the isolated blades. When identical damping elements are used, consequently all of the blades of a blade ring are detuned to an identical degree. Consequently, as a result of the different coupling with the aid of different damping elements in the blade ring, blades that are identical per se and have natural frequencies that are identical per se for different modes of vibration act as though the blades concerned—albeit uncoupled—had different natural frequencies for the modes of vibration. The use of different damping elements within a blade ring allows the magnitude of the natural frequencies of adjacent blades to be set such that immediately adjacent blades differ significantly with regard to their natural frequencies. In this way it is possible to obtain a blade ring of which the blades behave vibrationally in the ring as though they had different natural frequencies in spite of being of an identical embodiment (apart from the manufacturing tolerances) and consequently identical natural frequency (apart from the tolerances caused by manufacturing and each considered on its own). In other words: use of the different damping elements allows the natural frequencies of the blades arranged in the ring to be adjusted. Even when there is non-synchronous inducement, they experience less inducement, and consequently react with less vibrational response, whereby the tendency to flutter is reduced significantly.

During operation, the damping elements are pressed against the lower side of adjacent blade platforms of blades by the centrifugal force. As a result of the relative movements of adjacent blades, friction occurs between the damper and the blade platform, which brings about a coupling. The realization is based on the fact that the coupling brings about not only dissipation but also a frequency shift of the natural frequencies of adjacent blades. This effect can be used to detune the blades, preferably alternately. In spite of an identical embodiment, the adjacent blades act like blades with different natural frequencies merely because of the different damping elements. Such detuned blades have particularly little tendency to flutter, in particular if they are detuned alternately. Furthermore, the excursion of the frequency shift that can be achieved with the damping elements is significantly greater than in the case of the previous measures. Consequently, a blade ring according to the invention has a much lower tendency to flutter than blade rings with blades in which the blades have different natural frequencies. To this extent, the blade ring according to the invention is much more resistant to self-induced vibrations, and so-called fluttering, than conventional blade rings on account of the use of different damping elements between a pair of blades.

Consequently, the different damping elements can replace the otherwise commonly used measures for adjusting the natural frequencies, which is also known as "mistuning" These have been, for example, shortening the trailing edge at the blade tip, grinding the blade profile or drilling holes in the tip of the blade airfoil. The invention has the particular advantage that the mistuning of the blades with the two damping elements assigned to each blade allows the blade profile of the blade concerned to remain unchanged, and consequently does not involve any losses in performance, either in the stage or in the turbomachine, such as when shortening the trailing edges. It is consequently possible to dispense with the previous measures for adjusting the natural frequencies of the blades. Therefore, there is a saving in terms of time and cost, since it is possible to dispense entirely with the iterative process of repeated working of the blades along with repeated vibration measurements.

In this case, each blade of the blade ring is assigned to two blade pairs, with the provision of two or more groups of blade pairs, within which the damping elements are in each case identical and the damping elements of which differ from group to group.

In this case, a first group and a second group of blade pairs are provided, wherein each blade pair of the first group has an adjacent blade pair of the first group and an adjacent blade pair of the second group (AABBAABB series). As a result, a greater frequency detuning is achieved than in the case of the ABAB series, since the coupling stiffnesses of a blade that are obtained from the analogous model are significantly different from the adjacent blade.

A similarly effective frequency detuning can be achieved if a first group, a second group and a third group of blade pairs are provided, wherein each blade pair of one of the three groups has two adjacent blade pairs that respectively belong to one of the two other groups (ABCABC series).

Advantageous designs of the invention are specified in the dependent claims.

The different damping elements are preferably different with regard to the size, the mass, the cross-sectional contour, the material and/or the coupling contact with the blades. Such damping elements can be manufactured with low expenditure, without adapting the casting and the contour of blades for the different groups. For example, the damping elements differ in their geometrical form. For instance, even modes of vibration that cannot be effectively damped if the design of all the damping elements remains the same can be effectively damped with damping elements that are suitably formed. Alternatively or additionally, the damping elements may also differ in their masses, in order to effectively damp as large a number of different modes of vibration as possible by combination with suitable geometrical forms. Furthermore, the frictional conditions (friction coefficient, roughness) in the contact regions can be influenced by using damping elements of different materials, in order in this way also to make specific damping of a plurality of modes possible, even in increased frequency ranges.

In order to be able to arrange the damping elements suitably between adjacent blades, they are preferably formed as rods.

In the case of an actual development of the blade arrangement according to the invention, the damping element of a blade pair is of a multipart form. It comprises—as seen in the circumferential direction of the rotor—two (or more) subelements arranged one behind the other, which are preferably formed as rods. For example, one of the subelements has a cross section in the form of a wedge and the other subelement has a cross section in the form of a quarter circle. The advantages according to the invention can be achieved especially efficiently in particular by cross-sectional forms of the damping elements or parts thereof that are made to match one another.

In the case of a further actual development, the damping elements are manufactured from steel or ceramic, that is to say materials with which effective damping can be realized.

BRIEF DESCRIPTION OF THE DRAWINGS

An exemplary embodiment of a blade arrangement according to the invention is explained in more detail below on the basis of the appended drawing, in which.

DETAILED DESCRIPTION OF INVENTION

Figure 1:
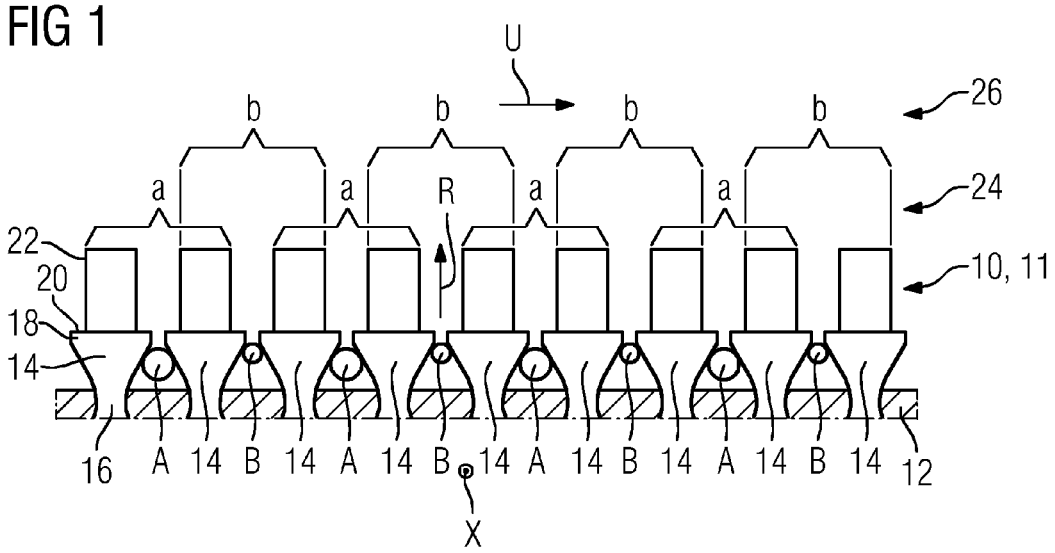
FIG. 1 shows the axial view of a detail of the geometric development of a rotor blade ring of an axial turbomachine with two damping elements arranged between the blades according to a first design.

In FIG. 1 there is shown part of the rotor blade ring 10 of blades 14 distributed along the circumference U on a rotor 12 of an axial-flow turbomachine that is not shown any further. The axial-flow turbomachine may be designed for example as a compressor, a steam turbine or a stationary gas turbine, which comprises the blade arrangement 11 with the ring 10 of blades 14. These blades have in each case a blade root 16 for fastening the respective blade 14 to the rotor 12. The blade root 16 is designed in a known manner in a dovetail form or else a firtree form. For fastening to the rotor 12 with positive engagement, said blade root 16 has been pushed into retaining grooves of the rotor 12 corresponding thereto, so that the blades 14 are securely retained during rotation of the rotor 12. The retaining grooves, and consequently also the blade roots 16, extend mainly in the axial direction and are inclined at an adjusting angle with respect to a machine axis.

In the outward direction, the blade root 16 goes over into a blade neck, which is not designated any more specifically and is adjoined by a platform 18. The platform surface 20 thereof delimits the flow channel of the axial-flow turbomachine. An aerodynamic curved blade airfoil 22 is arranged in isolation on the platform surface 20.

According to a first design, either damping elements of the type A or of the type B are provided on the underside of the platform 18, facing the blade root 16, between the platforms 18 of immediately adjacent blades 14. Both types A, B of damping elements are formed as rods, for example as damping wires. According to the embodiment that is shown in FIG. 1, the damping elements A, B have in each case a circular cross section. However, the damping elements of the type A have a larger diameter than the damping elements of the type B. Both damping elements A, B are therefore cylindrical.

During the rotation of the rotor 12, the damping elements A, B lying loosely between the platforms 18 are straining outward in the radial direction R and are pressed by the centrifugal force against the beveled undersides of adjacent platforms 18. Each damping element A lies against two immediately adjacent blades 14 forming a blade pair a. Similarly, each damping element B lies against two immediately adjacent blades 14 forming a blade pair b. On account of the circular cross section of the damping elements A, B, these elements lie against each blade 14, in each case forming a linear contact. Since each blade 14 has a damping element A, B on both sides of the blade neck, each blade 14 belongs to both blade pairs a, b. According to the blade arrangement 11 that is shown in FIG. 1, consequently a first group 24 of blade pairs a and a second group 26 of blade pairs b are provided, wherein each blade pair a (or b) of one group 24 (or 26) has an adjacent blade pair b (or a) of the other group 26 (or 24), as seen in the circumferential direction. On account of this design, the damping elements A, B are arranged alternately in series one behind the other in the circumferential direction U between two immediately adjacent blades 14. This design is also referred to as an arrangement with an ABAB pattern.

Figure 2:
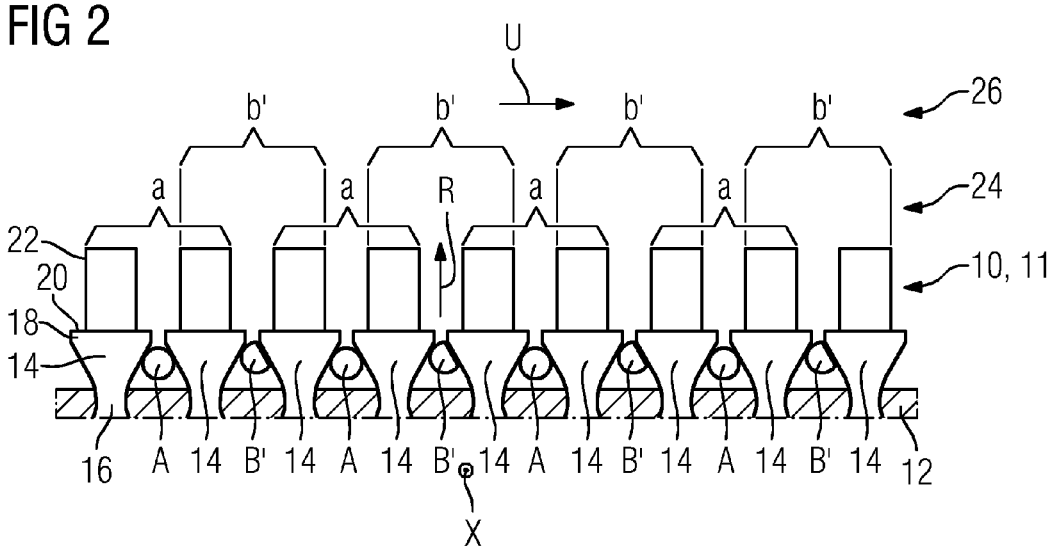
FIGS. 2, 4, 5, 6 and 7 show the detail according to FIG. 1, but with different damping elements according to further designs.

In FIG. 2 and in the other figures, identical features are provided with the same designations.

The design according to FIG. 2 differs from the design according to FIG. 1 merely in the form and design of the second damping element in each case. Instead of the damping elements B provided with a small diameter, damping elements B' that in principle have the same diameter as the damping elements of the type A are provided in FIG. 2, but the cross-sectional form of the damping elements B' is not circular but circular segmental. The form of the circular segment is chosen here such that the center point of the full circle is still enclosed by the cross-sectional area of the circular segment. As a result of the circular segmental form, the damping element B' lies flat against the one blade 14 (respectively shown on the right in FIG. 2) of the blade pair b and linearly against the other blade 14 (respectively shown on the left in FIG. 2) of the blade pair b'. According to the blade arrangement 11 that is shown in FIG. 2, consequently a first group 24 of blade pairs a and a second group 26 of blade pairs b' are provided, wherein each blade pair a (or b') of one group 24 (or 26) has an adjacent blade pair b' (or a) of the other group 26 (or 24), as seen in the circumferential direction U. Here, too, this is in principle a series with an ABAB pattern, in which the specified sequence of the damping elements A, B' or the blade pairs a, b' is repeated in a regular sequence along the circumference U of the blade ring 10.

Figure 3:
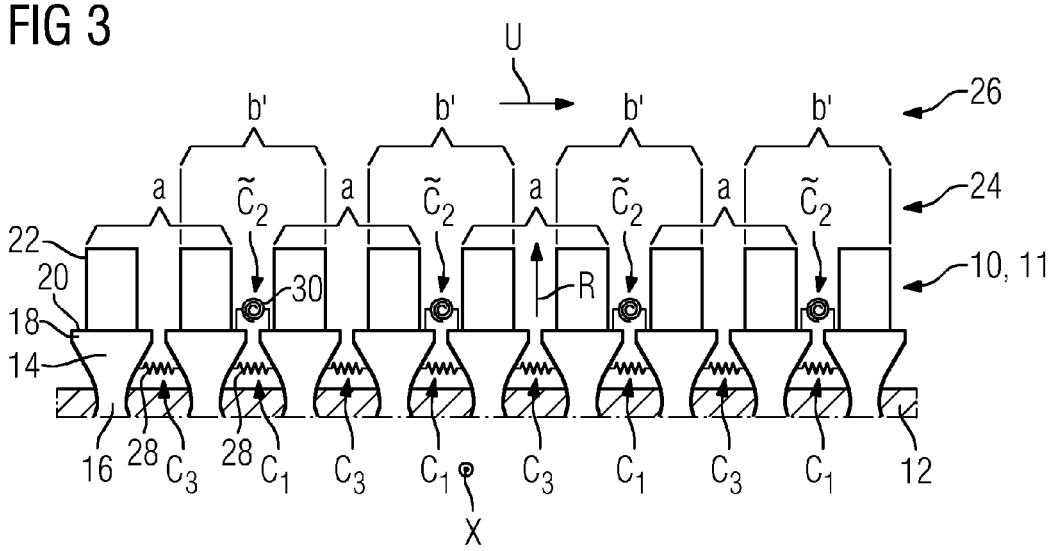
FIG. 3 shows a mechanical analogous model concerning the coupling of the blades of the blade ring with the aid of the damping elements.

FIG. 3 shows the detail of the geometric development of the blade ring 10 with rotor blades 14 as shown in FIG. 2, wherein the springs 28, 30 that are to be used in the analogous model of the damping elements A, B' are shown instead of the damping elements A and B'. Since the damping element A is a symmetrical or cylindrical damper, a translation spring 28 is shown in the analogous model for the coupling of the two blades 14 of the blade pair a. On account of the way in which the chordal portion lies flat against the beveled underside of the platform 18, the asymmetrical damping element B' enforces a torque in addition to the translation, with the result that in the analogous diagram a torsion spring 30 is shown in addition to the translation spring 28 between the blades 14 of the blade pair b'. The translation springs 28 have a coupling stiffness C1, C3 and the torsion spring has a coupling stiffness C2. The total coupling stiffness of an individual blade 14 is then obtained by the parallel arrangement of the coupling stiffness C3 and the coupling stiffnesses C2 and C1. The springs may in this case also have non-linear properties.

Since the blade airfoils 22 are adjusted with respect to the axial direction X, and consequently the two sides of the platform 18 of a blade 14 laterally of the blade airfoil 22 are designed asymmetrically, the series with the ABAB pattern of damping elements A, B or A, B' brings about an alternating frequency detuning of blades 14, whereby the natural frequencies of immediately adjacent blades 14 are shifted just by the use of different damping elements A, B, B'. The shift of the frequencies prevents the propagation of circulating vibration waves in the bladed ring during operation, which makes it more difficult for the blade airfoils 22 to be induced to flutter. This increases the operating range of the axial-flow turbomachine and ensures dependable operation.

Further designs for detuning the natural frequencies of modes of vibration of blades 14 are shown in FIG. 4, FIG. 5, FIG. 6 and FIG. 7. Further series with different patterns are indicated by way of example therein.

Figure 4:
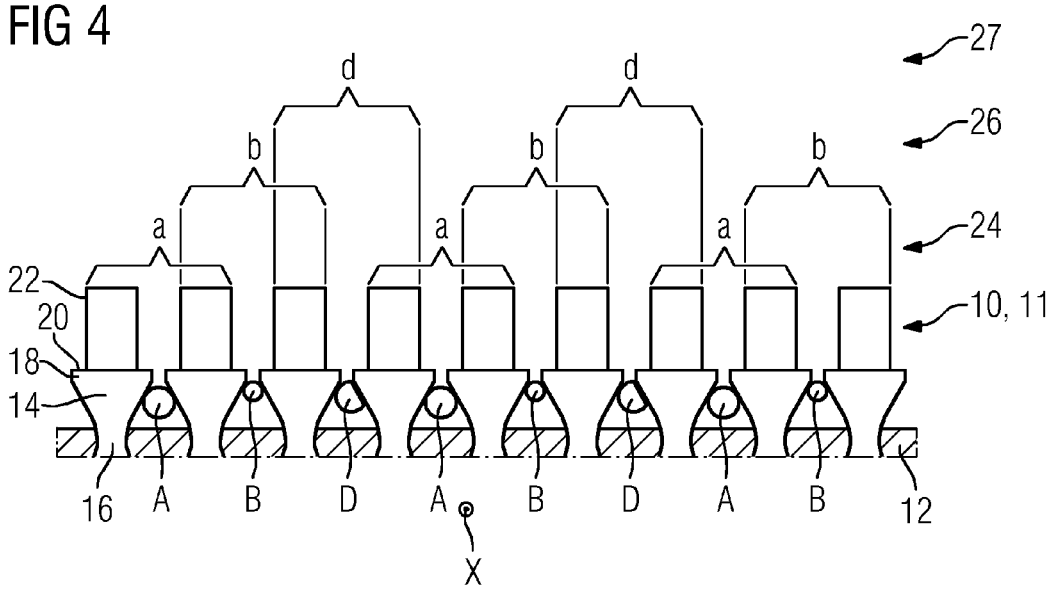

FIG. 4 shows a new series with three groups 24, 26, 27 of blade pairs a, b, d, wherein each blade pair a or b or d of a group 24 or 26 or 27 has two adjacent blade pairs b, d or a, d or a, b, which belong in each case to one of the two other groups 26, 27 or 24, 27 or 24, 26, respectively. A damping element of the type A is provided between the two blades 14 of each blade pair a. Said damping element is circular in cross section and has a rather larger diameter. Each blade pair b is assigned a damping element of the type B, which is also circular in cross section. Compared with the damping element of the type A, however, the diameter of the damping element of the type B is smaller. Each blade pair d is assigned a damping element of the type D. In the exemplary embodiment shown, the design thereof corresponds to the design of the damping element of the type B' from FIG. 2. This design accordingly has an ABCABC series.

Figure 5:
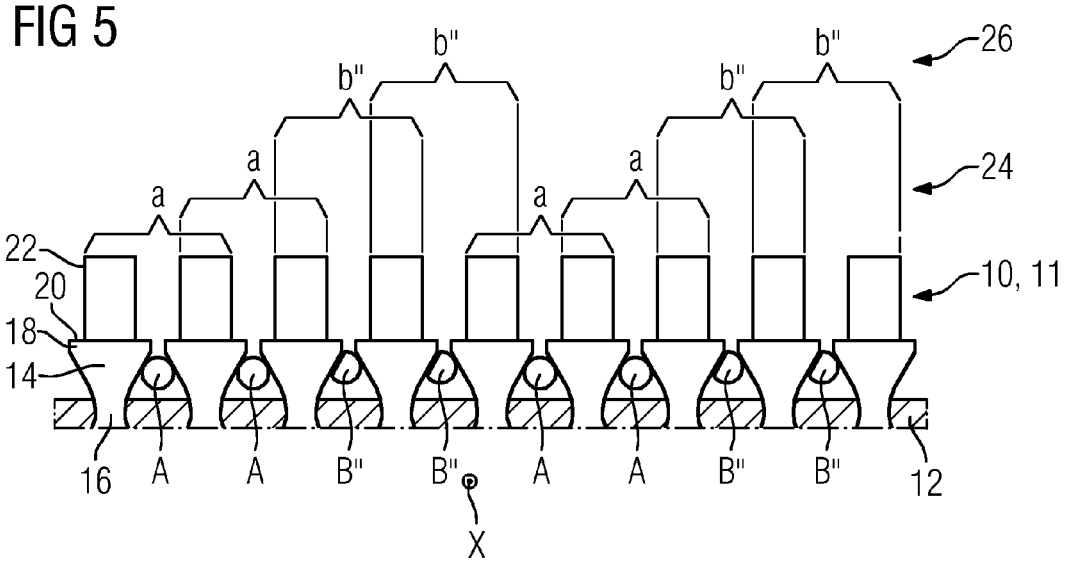

FIG. 5 shows a further blade arrangement 11, in which a first group 24 and a second group 26 of blade pairs a, b" are provided, wherein each blade pair a of the first group 24 has an adjacent blade pair a of the first group 24 and an adjacent blade pair b" of the second group 26. A damping element of the type A is provided between the two blades 14 of each blade pair a. Said damping element is circular in cross section and has a rather larger diameter. Each blade pair b" is assigned a damping element of the type B", the cross section of which is circular segmental. This design can also be described as an AABBAABB series.

Figure 6:
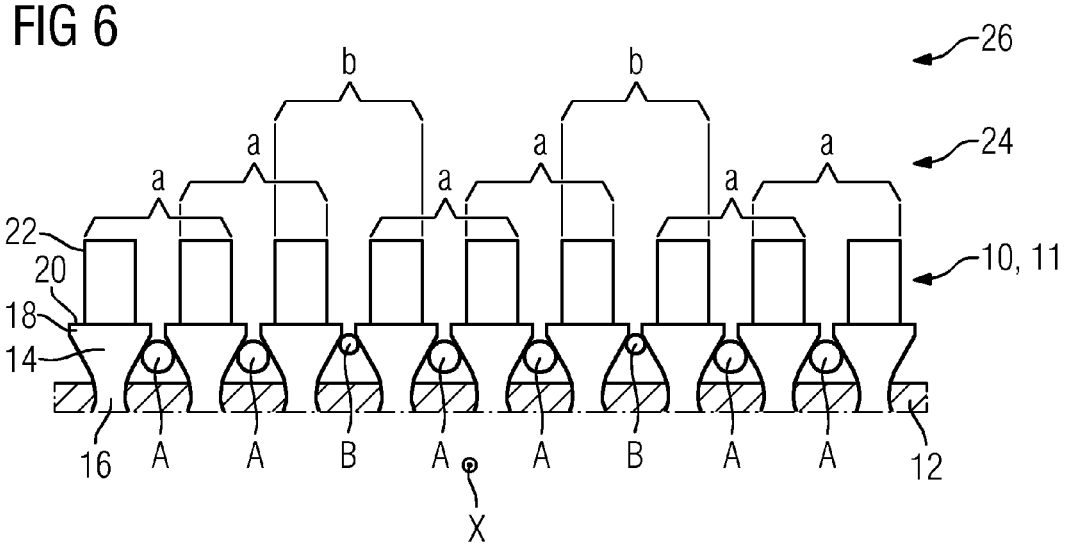

An alternative design with an ABBABB series is shown schematically in FIG. 6. Here, too, the different types A, A, B" of the damping elements are distributed in a recurring sequence along the circumference between the blades 14 of the blade ring 10.

Figure 7:
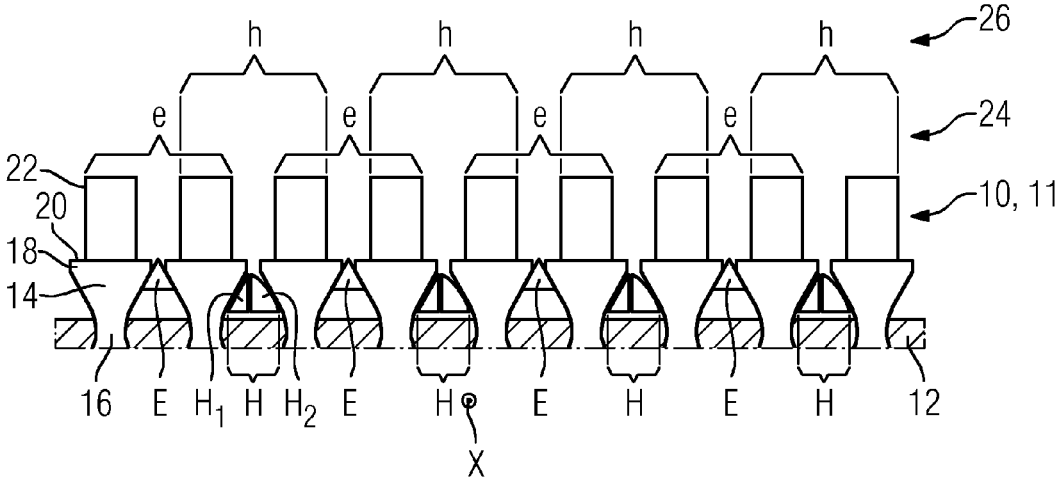

Finally, FIG. 7 shows a further ABAB series of modified damping elements E, H in a rotor blade ring. A first group 24 of rotor blade pairs e has in each case a damping element of the type E between the respectively associated blades 14. The damping element E is also designed in principle in the form of a rod. By contrast with the previously shown designs of damping elements A, B, B', B", however, D is designed in a triangular form in cross section, so that it lies flat against each blade 14 of the blade pair e assigned to it. The damping element H, which is different from the damping element E, is of a multipart design and comprises in each case two parts H1, H2. The part H1 is triangular in cross section and the part H2 has in cross section the contour of a circular sector in the form of a quarter circle. As a result, two areal contacts and one linear contact are obtained for each damping element H.

The blade arrangements 11 shown in FIGS. 4, 5, 6 and 7 have higher coupling stiffnesses than the designs according to FIG. 1 or FIG. 2, whereby blades 14 immediately adjacent one another can be detuned even more in their frequency properties. To this extent, these blade arrangements 11 are particularly suitable when a frequency detuning of blades 14 of a blade ring 10 is intended to be brought about with the aid of different damping elements in order to prevent the blades 14 from being induced to flutter.

Depending on the number of blades 14 in the blade ring, one of the aforementioned blade arrangements 11 can be used particularly favorably. It goes without saying that, if the number of blades in the ring is not divisible by two or three, it is also possible to use a greater number of types of damping element for each blade ring 10.

If the blade ring 10 has a number of blades 14 that is not an integral multiple of the number of types of damping elements of the series, it goes without saying for all of the designs that there is the possibility that only a majority of the successive blade pairs (a, b, b', b", d, e, h) are members of the series and form it. The other blade pairs are then provided with suitable damping elements that cannot be subsumed in the series. In this case there is also the possibility that the blade ring 10 actually has two adjacent blades 14 with identical or almost identical frequency properties.

In addition, a wide variety of the types of damping element can be conceived and combined with one another, with the result that the exemplary embodiments presented here are in no way to be understood as limiting. Even the circumferentially alternating arrangement of damping elements of the type B' and of the type B" leads to an alternating frequency detuning on account of the coupling stiffness varying from blade to blade that has already been mentioned further above.

For example, it would be conceivable that grooves (grooved damping elements) are provided along the cross-sectional contour as a distinguishing feature between damping elements of different types. Moreover, different series of types of damping elements are also similarly possible, for example an ABCBABCBA series.

Altogether, the invention consequently relates to a blade arrangement 11 with a rotor 12 and a plurality of blades 14 which are distributed in a ring 10 along the circumference U of the rotor 12, wherein two immediately adjacent blades 14 of the ring 10 form a blade pair a, b, b', b", d, e, h, between the blades 14 of which a damping element A, B, B', B", D, E, H is arranged and wherein the respective damping element A, B, B', B", D, E, H comes into contact with the two blades 14 of the blade pair a, b, b', b", d, e, h assigned to them during a rotation of the rotor 12 about a rotor axis as a result of a centrifugal force acting in the radial direction R. In order to bring about a frequency detuning of the vibration properties of blades 14, whereby machining of the blade airfoil 22 becomes unnecessary, it is proposed that the blade ring 10 has at least two blade pairs a, b, b', b", d, e, h with different damping elements A, B, B', B", D, E, H.

The invention claimed is:

1. A blade arrangement, comprising:

a rotor; and a plurality of blades which are distributed in a ring along the circumference of the rotor and each of the plurality of blades comprises respectively in succession a blade root, a platform and a blade airfoil, wherein two immediately adjacent blades of the ring form a blade pair and include at least one damping element, wherein each respective at least one damping element comes into contact with each platform of each blade of the blade pair during a rotation of the rotor about a rotor axis as a result of a centrifugal force acting in a radial direction, wherein, for adjusting the natural frequencies of each of the plurality of blades, the blade ring includes at least two blade pairs with different at least one damping element and each of the plurality of blades of the ring is assigned to two different blade pairs and wherein two groups of blade pairs are provided, within each group the damping elements are in each case identical and the damping elements differ from group to group, wherein a first group and a second group of blade pairs are provided, and wherein a majority of the blade pairs or each blade pair of the first group has an adjacent blade pair of the first group and an adjacent blade pair of the second group.

2. The blade arrangement according to claim 1, wherein at least one of the at least one damping element differs from a different one of the at least one damping element with regard to a size, a mass, a cross-sectional contour, a material and/or a type of coupling contact with the plurality of blades.

3. The blade arrangement as claimed in claim 1, wherein the at least one damping element of a blade pair is of a multipart form.

4. A gas turbine comprising:

a blade arrangement comprising:

a rotor; and a plurality of blades which are distributed in a ring along the circumference of the rotor and each of the plurality of blades comprises respectively in succession a blade root, a platform and a blade airfoil, wherein two immediately adjacent blades of the ring form a blade pair and include at least one damping element, wherein each respective at least one damping element comes into contact with each platform of each blade of the blade pair during a rotation of the rotor about a rotor axis as a result of a centrifugal force acting in a radial direction, wherein, for adjusting the natural frequencies of each of the plurality of blades, the blade ring includes at least two blade pairs with different at least one damping element and each of the plurality of blades of the ring is assigned to two different blade pairs and wherein two groups of blade pairs are provided, within each group the damping elements are in each case identical and the damping elements differ from group to group, wherein a first group and a second group of blade pairs are provided, and wherein a majority of the blade pairs or each blade pair of the first group has an adjacent blade pair of the first group and an adjacent blade pair of the second group.

5. A blade arrangement, comprising:

a rotor; and a plurality of blades which are distributed in a ring along the circumference of the rotor and each of the plurality of blades comprises respectively in succession a blade root, a platform and a blade airfoil, wherein two immediately adjacent blades of the ring form a blade pair and include at least one damping element, wherein each respective at least one damping element comes into contact with each platform of each blade of the blade pair during a rotation of the rotor about a rotor axis as a result of a centrifugal force acting in a radial direction, wherein, for adjusting the natural frequencies of each of the plurality of blades, the blade ring includes at least two blade pairs with different at least one damping elements and each of the plurality of blades of the ring is assigned to two different blade pairs and wherein two or more groups of blade pairs are provided, within each group the damping elements are in each case identical and the damping elements differ from group to group, and wherein a first group, a second group and a third group of blade pairs are provided wherein a majority of the blade pairs or each blade pair of a group has two adjacent blade pairs that respectively belong to one of the two other groups.

* * * * *